US005575722A

United States Patent [19]

Saia et al.

[11] Patent Number: 5,575,722

[45] **Date of Patent: *Nov. 19, 1996**

[54] GOLF CLUB STABILIZER AND METHOD OF STABILIZING A GOLF CLUB

[75] Inventors: Carman R. Saia; Greg Foster, both of Bellingham, Wash.

[73] Assignee: Vertebrex Golf L.L.C., Bellingham, Wash.

[ * ] Notice: The term of this patent shall not extend beyond the expiration date of Pat. No. 5,478,075.

[21] Appl. No.: 524,369

[22] Filed: Sep. 6, 1995

Related U.S. Application Data

[63] Continuation-in-part of Ser. No. 266,738, Jun. 27, 1994, Pat. No. 5,478,075.

[51] Int. Cl.[6] ..... A63B 53/00

[52] U.S. Cl. ..... 473/300; 473/318

[58] Field of Search ..... 273/80 R, 80 B, 273/81 R, 81 A, 162 R, 162 F, 32 R, 67 R, 67 DB, 73 J, 75; 473/316, 318, 300, 297

[56] References Cited

U.S. PATENT DOCUMENTS

| | | | |
|---|---|---|---|
| 1,580,744 | 4/1926 | Harmon . | |
| 1,704,544 | 3/1929 | Novak . | |
| 1,950,342 | 3/1934 | Meshel . | |
| 2,023,131 | 12/1935 | Gibson | 273/80 B |
| 2,051,083 | 8/1936 | Hart | 273/81 A |
| 2,085,915 | 7/1937 | MacCallum . | |
| 2,992,828 | 7/1961 | Stewart . | |
| 3,372,932 | 3/1968 | Molis . | |
| 3,679,207 | 7/1972 | Florian . | |
| 3,762,707 | 10/1973 | Santorelli . | |
| 3,833,223 | 9/1974 | Shuikin . | |
| 3,897,058 | 7/1975 | Koch . | |
| 4,058,312 | 11/1977 | Stuff et al. . | |
| 4,090,711 | 5/1978 | Amato | 273/80 R |
| 4,203,598 | 5/1980 | Stuff et al. . | |
| 4,452,456 | 6/1984 | Kochevar . | |
| 4,461,479 | 7/1984 | Mitchell . | |
| 4,470,600 | 9/1984 | Parente et al. . | |
| 4,496,153 | 1/1985 | Kochevar . | |
| 4,690,407 | 9/1987 | Reisner . | |
| 4,988,102 | 1/1991 | Reisner . | |
| 5,004,236 | 4/1991 | Kameshima . | |
| 5,054,781 | 10/1991 | Soong . | |
| 5,083,780 | 1/1992 | Walton et al. . | |
| 5,253,867 | 10/1993 | Gafner . | |
| 5,261,669 | 11/1993 | Kochevar . | |
| 5,294,119 | 3/1994 | Vincent et al. . | |
| 5,465,967 | 11/1995 | Boeckenhaupt | 273/81 A |

FOREIGN PATENT DOCUMENTS

| | | |
|---|---|---|
| 134473 | 1/1985 | European Pat. Off. . |
| 823727 | 1/1938 | France . |
| 2605523 | 4/1988 | France . |
| 4016650 | 11/1991 | Germany . |
| 20180 | of 1904 | United Kingdom . |
| 2149311 | 6/1985 | United Kingdom . |

*Primary Examiner*—Sebastiano Passaniti
*Attorney, Agent, or Firm*—Seed and Berry LLP

[57] ABSTRACT

A golf club stabilizer having a plurality of rubber discs all connected to a single threaded rod. In one embodiment, all of the discs can be expanded into contact with the shaft of the golf club uniformly or they can be varied in selectively different amounts. The discs can all be tightened to make the club very stiff or they can be tightened only loosely to make the club more stiff than without the discs but less than with fully tightened discs, The kick point of the club can also be varied by leaving some of the discs in a relaxed state out of contact with the shaft and doing this with any of the discs along the several discs in the club. In another embodiment, the discs of a diameter greater than the internal diameter of the shaft can be connected to the rod, lubricated, and forcibly pressed into the shaft. A method of stiffening a golf club shaft by connecting a plurality of elastomeric discs to a rod at spaced locations and inserting the rod and discs into the shaft with the discs in a tightly compressed condition in the shaft.

19 Claims, 4 Drawing Sheets

GOLF CLUB STABILIZER AND METHOD OF STABILIZING A GOLF CLUB

CROSS REFERENCE TO RELATED APPLICATIONS

This application is a continuation in part of application Ser. No. 08/266,738, filed Jun. 27, 1994 now U.S. Pat. No. 5,478,075.

TECHNICAL FIELD

This invention relates to improvements to stiffen a desired location in a golf club to control the flex and/or twist in the club.

BACKGROUND OF THE INVENTION

When playing golf, the golfer often strives to obtain the longest distance when striking the ball in order to carry the ball further down the fairway. This can be accomplished either by developing the strength and skill of the golfer or using a golf club shaft of a more flexible material such as light, thin-walled tubular metal, fiberglass, carbon fiber, or other composites. The added flexibility in the shaft is intended to deliver the head of the shaft at a greater velocity when the head strikes the ball. This greater velocity being achieved not only by the stroke of the golfer swinging the club, but also the recovery of the energy stored in the shaft when it is initially being flexed so that part of that springiness in the flex will be recovered as velocity at the club head just prior to striking the ball.

The difficulty with more flexible golf club shafts, however, is that the less experienced golfer loses control of the exact angle at which the face of the club head strikes the ball at the moment of contact with the ball. This results in the ball not traveling straight even though it may have a longer distance. In addition, the increased flex of the shaft will result in a twist at the grip end of the shaft or a bending at the grip end of the shaft which results in the golfer loosening the golfing grip, allowing the club to slip or twist in the hands of the golfer. This destroys the desired feel of the club grip, and also can cause the ball to travel in a non-straight path.

Different types of shaft stiffening devices have been shown in prior literature. However, these are difficult to install and, once installed, result in a permanent change in the stiffness of the club shaft.

SUMMARY OF THE INVENTION

The present invention provides a solution to the golf club flexing of modern golf club shafts by providing an adjustable stiffening means, preferably in the grip end of the shaft, allowing the stiffness of the grip end of the shaft to be varied from very stiff to lightly stiff.

In one embodiment of the invention, the stiffening means includes stiffening members spaced in the grip end of the shaft and any one of the gripping members can be expanded into contact with the shaft relative to the others to vary the stiffness along the length of the grip end of the shaft.

The advantages of the adjustable stiffening members spaced along the grip end of the shaft are that the entire grip end of the shaft can be made stiffer, thus moving the kick point of the shaft down further towards the head end of the shaft. This basically stiffens the club shaft so that some of the flex is removed, thereby giving greater control of the shaft and resulting in a straighter drive of the ball.

Another advantage is that the spaced stiffening members can be made to only lightly stiffen the grip end of the club, thereby allowing more flex, but some stiffness. Any combination of very stiff to lightly stiff along the entire length of the grip end of the club can be achieved. This stiffness can be varied as the golfer progresses in skill so that a golfer who initially finds a club too flexible can stiffen the club and as the golfer's skill increases, the amount of stiffness can be reduced accordingly.

Another advantage is that the stiffness can dampen vibrations in the shaft.

The stiffening members can also be varied independently of one another along the length of the grip end of the shaft as, for example, to stiffen only the stiffening members adjacent the outer end of the shaft, thereby moving the kick point up further along the shaft but less than where its location would be without any stiffeners in the grip end of the shaft.

In addition, the spaced stiffening members along the length of the shaft can be varied independently of the others as for example by engaging the stiffening members at the grip end of the club closest to the head end and closest to the outer end but leaving a relaxed area with the stiffening members not engaged with the shaft in the center of the grip end of the club, to create a soft feel in the grip end of the club.

Accordingly, the invention should allow golfers to grow or adjust to their clubs as they acquire more skill, permanently control the amount of flex in the shaft or provide other variations of shaft stiffness and feel to accommodate their particular skill level and strength.

in another embodiment of the invention, the stiffening members can be fixed to a diameter slightly greater than the internal diameter of the grip end of the shaft to obtain a desired stiffness, and then lubricated and forcibly inserted into the grip end to provide permanent stiffening within the grip end of the shaft. In this embodiment either the adjustable stiffening members can be pre-set to the desired diameters in advance outside of the grip end of the shaft, or the stiffening members can be initially manufactured to permanent fixed diameters before being inserted into the shaft.

DETAILED DESCRIPTION OF THE INVENTION

Figure 1:
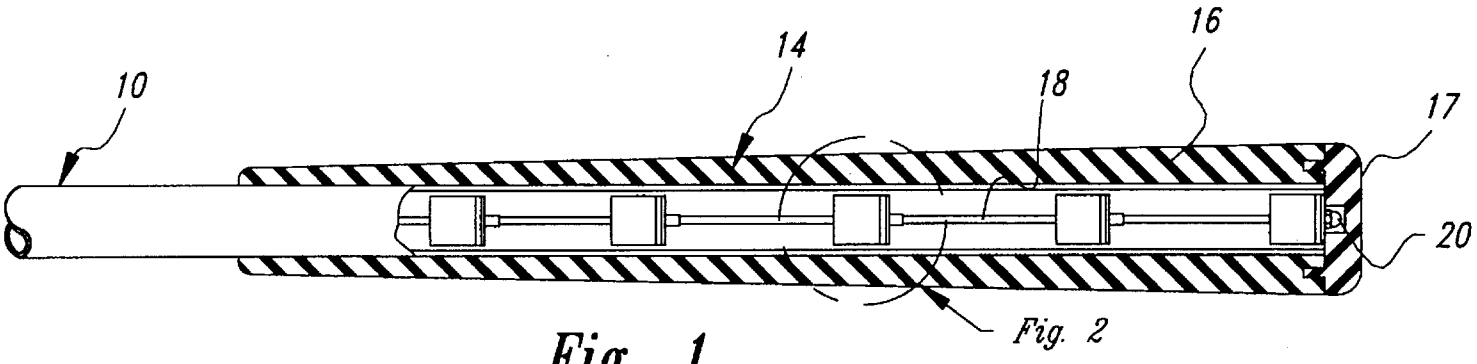
FIG. 1 is a fragmentary section of a hollow golf club shaft having adjustable stiffening mechanisms according to the teachings of the invention.
Figure 3:
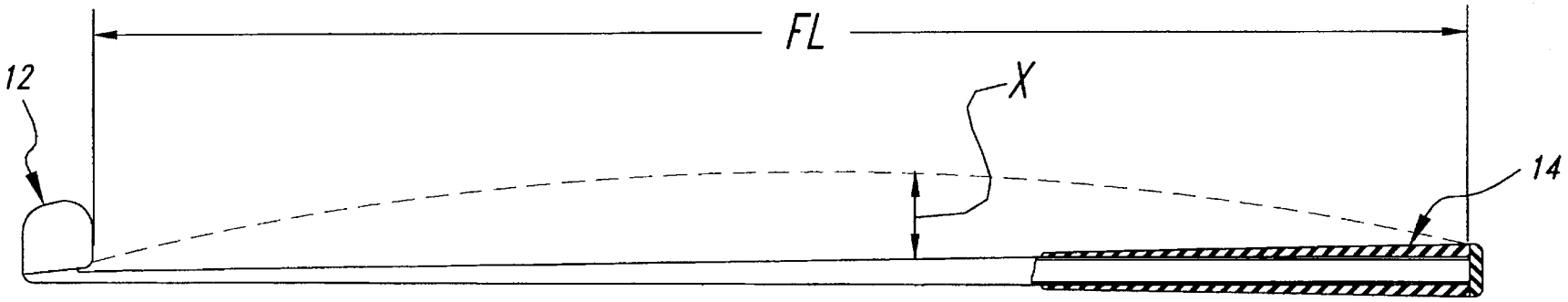
FIG. 3 shows a golf club shaft of standard configuration without the stiffening members of the instant invention.

FIG. 1 illustrates a typical golf club shaft 10 made from either lightweight tubular metal, fiberglass, carbon fiber or other composite materials. The hollow shaft has a head end 12 (FIG. 3) and a grip end 14. The grip end may be covered by a typical rubber wrap 16 sealed off by a plug 17.

Figure 2:
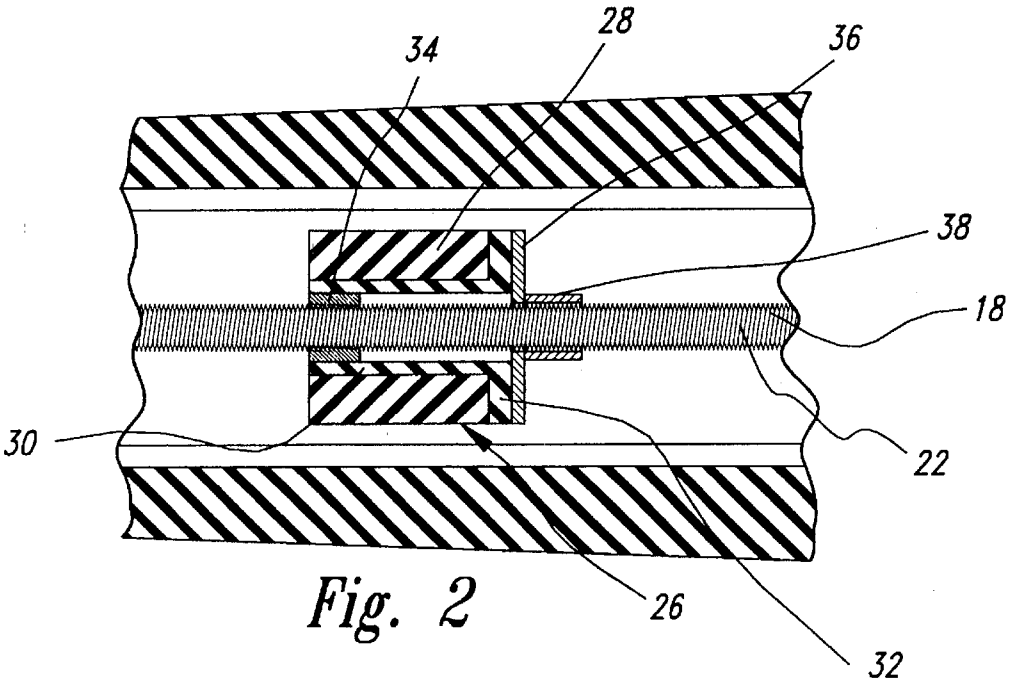
FIG. 2 is an enlarged detail of a portion of the shaft stiffening mechanism shown in FIG. 1.

As best shown in FIGS. 1 and 2, stiffening or friction members 26 of this invention are activated by an elongated threaded rod 18 having at its outer end a lock nut 20 fixed to the rod and along its length a plurality of threads 22.

Each stiffening member 26 includes a soft rubber cylinder 28 fitted over a rubber sleeve 30. The rubber sleeve has an enlarged end 32 at one end and a threaded nut 34 which is bonded or vulcanized to the rubber sleeve at the opposite end of the sleeve. These sleeves are conventional devices and operate such that when the rod 30 is threaded through the nut 34, the nut moves axially to the right (in FIG. 2) along the threaded rod, squeezing the center portion of the rubber sleeve radially outwardly. This expands the rubber cylinder 28 outwardly into tight contact with the inner wall of the shaft. The amount of grip or tightness between the rubber cylinder and the shaft can be varied by the amount of torque placed on the rod 18.

In order for the sleeve to expand, the enlarged end of the sleeve must be held against axial movement. This is achieved by the use of a washer 36 which abuts against a ferrule 38. The ferrule is locked to the threaded rod either by bonding, crimping, or by smashing a thread along the rod so that the ferrule cannot pass beyond the mashed thread.

Figure 4:
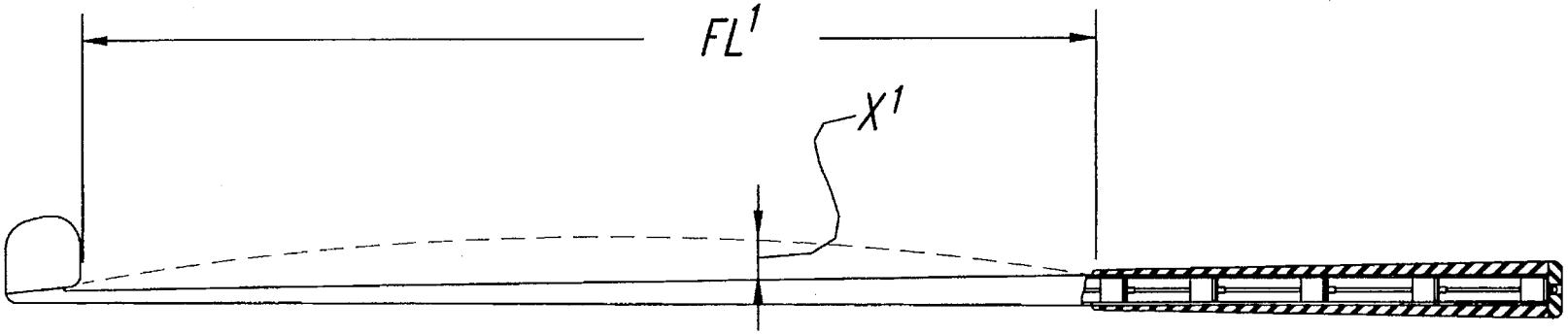
FIG. 4 shows a golf club shaft with the stiffening members of the invention showing an increased stiffness.

As best shown in FIG. 1, there are several of these gripping members 26, in one embodiment five spaced along the grip end. While these gripping members in the rod can be placed anywhere along the length of the shaft, they are preferably placed at the Grip end of the shaft as shown. The gripping members 26 can all be simultaneously and uniformly radially expanded to the approximate same tightness against the inside of the shaft. This is accomplished by initially radially expanding each of the discs until they are in frictional engagement with the inside of the shaft when they are inserted into the grip end of the shaft. Then by rotating the lock nut 20 and the rod, all of the gripping members are simultaneously uniformly expanded into contact with the grip end of the shaft. This stiffens the entire grip end of the shaft and produces a reduced amount of flex, as shown in FIG. 4. In FIG. 4, the amount of flex is shown schematically as $X^1$, and the length of that flex along the handle is shown schematically as $FL^1$. This is to be compared with the schematic illustration of the greater amount of flex shown as X in FIG. 3 and with the greater length of the flex along the handle as shown as FL in FIG. 3.

Figure 5:
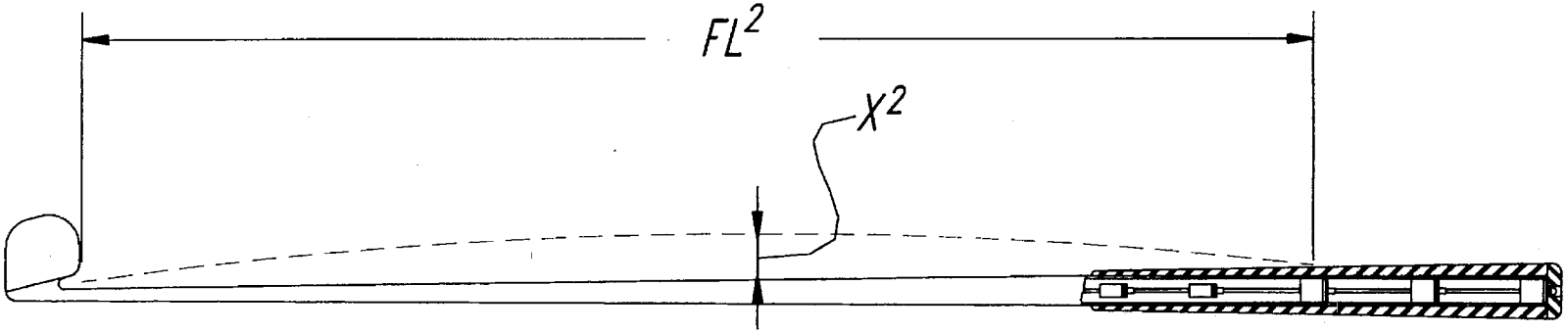
FIG. 5 is a golf club shaft with the stiffening members of this invention showing some of the stiffening members being energized and others not, and the resulting schematic illustration of the change in the flex of the shaft.

The gripping members can also be selectively radially expanded, either in groups or any particular one, FIG. 5 illustrates expanding the three most outward gripping members but leaving the two most inner gripping members in the relaxed or non-expanded state. This provides an amount of flex $X^2$ which is greater than $X^1$ but less than X, and a length of that flex $FL^2$ which is greater than the length of the flex $FL^1$ but less than the length of the flex FL. As is apparent, any one of these stiffening members can be left relaxed and any number can be expanded.

Figure 6:
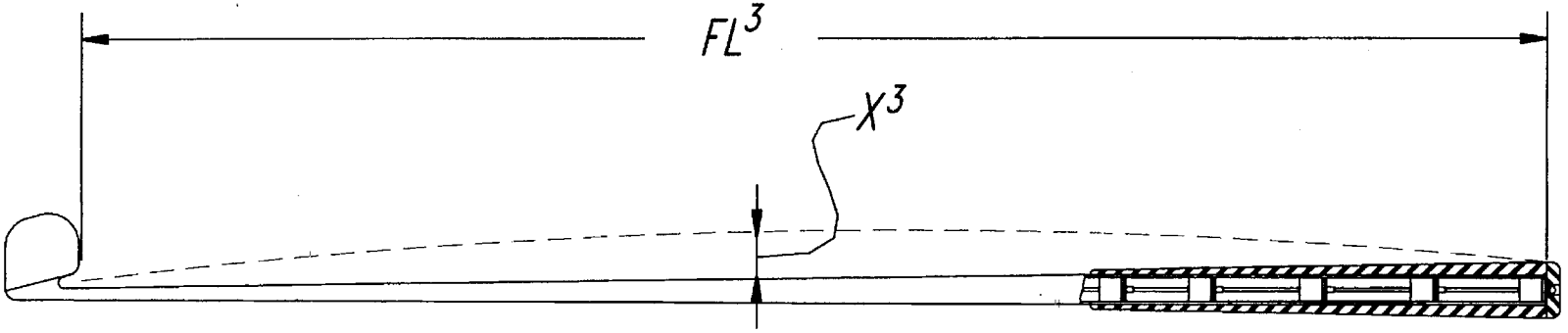
FIG. 6 shows a golf club shaft embodying the stiffening members of the invention with all the stiffening members only lightly pressed against the shaft, and showing schematically the resulting flex of the shaft.

FIG. 6 shows a situation in which all of the stiffening members 26 are radially expanded but to an amount less than the tightest amount that is illustrated by comparison in FIG. 4. While the stiffening members are all uniformly expanded, they are only uniformly expanded into lighter contact with the hollow shaft, resulting in an amount of flex $X^3$ which is somewhere less than flex amount X but greater than the flex amount $X^1$. Similarly, the length of that flex $FL^3$ is somewhat greater than that of $FL^1$ but is less than and is approximately the same as the flex length FL.

It should be understood that these exact amounts of flex and the lengths of flex are not exactly known, but are only interpreted in general terms as the resulting effect of tightening any or all of the stiffening members against the hollow shaft.

Figure 7:
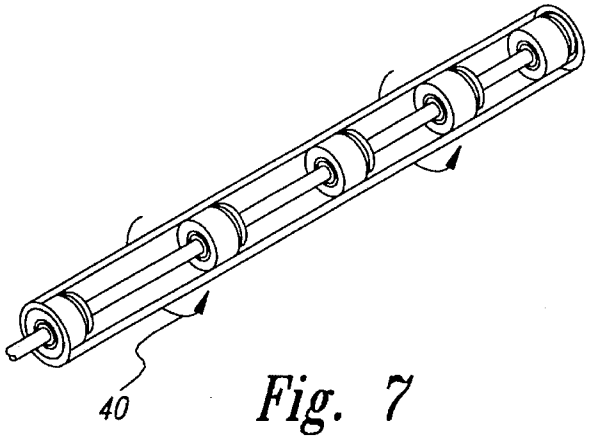
FIG. 7 shows the grip end of the shaft embodying the principles of the invention with all gripping members engaged producing a reduced amount of twist in the grip end of the shaft.

FIG. 7 illustrates a typical grip end of a shaft with the stiffening members all tightly expanded against the wall of the shaft. The arrows 40 are intended to show small amounts of twist in the handle, since the handle is more stiff and now resists the twist when the club strikes the ball.

Figure 8:
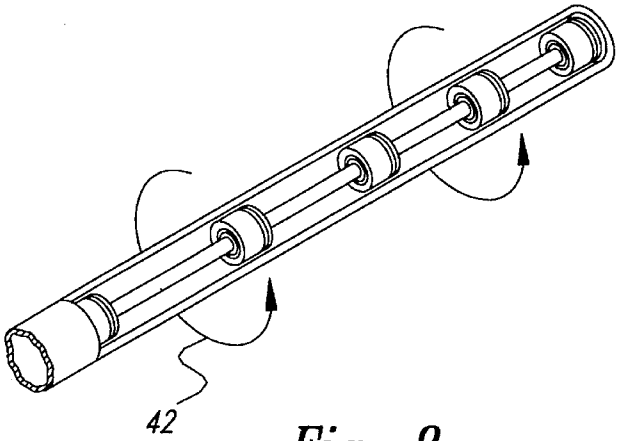
FIG. 8 shows the grip end of the shaft embodying the gripping members of the invention but with the gripping members all relaxed so that the club has its normal greater twist in the grip end of the handle.

By comparison, FIG. 8 shows a typical golf club grip end but with the gripping members 26 all in the relaxed state so that they have no effect on the grip end of the shaft. This results in larger twist shown by the longer arrows 42. Thus it can be shown that, not only do the stiffening members change the amount of flex in the club and the length of the flex in the club, but they also change the amount of twist in the club, reducing that twist where it is desirable for the particular golfer.

Figure 9:
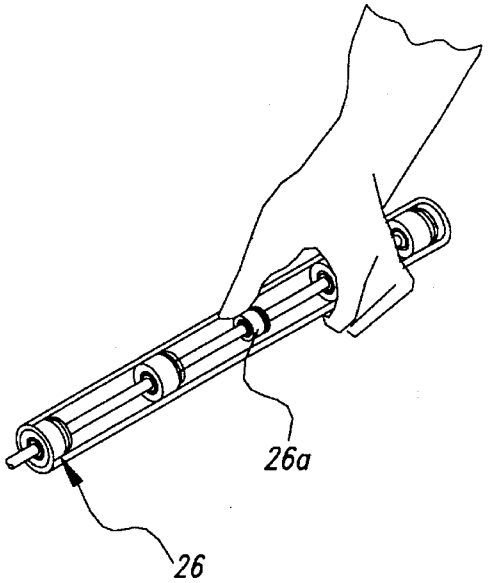
FIG. 9 shows a fragmentary grip end of a golf club shaft embodying the gripping members of the invention but with an intermediate gripping member relaxed, whereas the other gripping members are all expanded into contact with the shaft to show how the feel of the grip can be varied.

FIG. 9 illustrates a golf club grip end of the shaft with all of the gripping members 26 tightly engaged against the shaft except the intermediate or central-most gripping member. This gripping member is illustrated with reference number **26*a*** and is left in a relaxed state. This produces a slight softness or flex in the handle adjacent where the golfer will place his thumb, but retains greater stiffness outward and inward of that location. The resulting effect is a stiffer acting club but with a softer feel than would occur if all of the stiffening members were expanded against a shaft.

While the various embodiments of the invention have been illustrated and described, it should be understood that variations will occur to those skilled in the art without departing from the principles herein. For example, any one of the stiffening members 26 may be left relaxed while others are stiffened. Various lengths of energizing rods and stiffening members may be used for different clubs, for example, approximately 13 inches for a men's driver, 12 inches for other men's woods, and 11 inches for higher numbered woods such as a 5 wood and in some cases irons.

Women's clubs would generally have stiffening members and energizing rods about one inch shorter than the equivalent men's, being approximately 11 inches long for the highest wood such as a 5 wood or some of the irons, and 12 inches for the 3 wood and 13 inches for the driver.

As an alternative, a single set of discs and energizing rods can be used for all clubs, both men's and women's, and the stiffening effect adjusted by leaving the innermost disc or discs in the relaxed state so that the effect is similar to having used a shorter energizing rod and number of discs.

Figure 10:
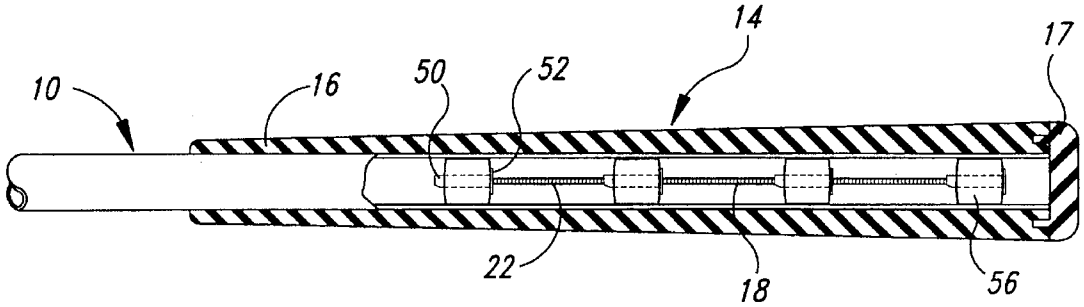
FIG. 10 shows a fragmentary grip end of a golf club shaft having stiffening members that are fixed in diameter before being inserted into the shaft.

The adjustable discs could, of course, be set to a desired diameter outside of the shaft and fixed in that position or remain adjustable. The pre-set discs could then be lubricated and forcibly pressed into the shaft. Another embodiment of less expensive construction, where the discs are pre-set, is shown in FIG. 10. In this embodiment rivets 50 having enlarged heads 52 are fixed to the rod 18. The rivets can be slid or threaded into place on the threaded rod and locked in place by crimping or deforming a thread on the rod. The rivets can also be secured to an unthreaded rod and locked in place, as by crimping the rivet tightly against the rod. In this embodiment elastomeric sleeves or discs 56 are fitted tightly on the rivets and abut the heads of the rivets. The size and diameter of the discs are selected to provide a desired stiffness when inside the shaft and their outside surface is lubricated. The entire rod with the fixed discs is then pressed manually or pneumatically forcibly into the grip end of the shaft. Any suitable lubricant that will lose its lubricity in air with time can be used, and aqueous solutions containing ester-based surfactants are preferred. Furthermore, lubricants containing organic solvents or that are oil based, as well as silicone-containing lubricants, should be avoided. A variety of suitable lubricants are commercially available, and a lubricant called "ZIP CARE" manufactured by McNett Corporation, of Bellingham, Wash., U.S.A. is preferred.

The durometer (Shore A) of the discs is desirably between 45–60 and preferably 45–50. Discs approximately ⅜ inches long and ½ inch in outside diameter prior to insertion in the golf club shaft have been found to work satisfactorily to be fitted into a shaft having a smaller internal diameter requiring ten to fifteen percent (10%–15%) compression of the disc when inserted depending on the internal diameter of the shaft.

A method of stiffening the grip end of a golf club shaft can be followed by inserting radially adjustable elastomeric discs connected at spaced locations to a rigid rod into the shaft and radially expanding the discs into tight engagement with the internal diameter of the golf shaft. The method can also include pre-setting adjustable discs or manufacturing the diameter of the discs outside of the shaft to a diameter larger than the internal diameter of the shaft, lubricating the discs, and forcibly pressing the discs and rod into the shaft.

We claim:

1. A shaft stabilizer for hollow shaft golf clubs of the type having a grip end at one end of the shaft and a head end at the opposite end of the shaft, comprising:

a golf club hollow shaft;

a plurality of elastomeric discs spaced from one another along the shaft and compressed into tight engagement with the hollow shaft; and a common rod operatively connected to each disc, the rod interconnecting each disc to provide an internal stiffening member providing contact with the shaft at several spaced locations along the grip end of the shaft to stiffen the hollow shaft along the points of engagement; the discs being of a diameter and hardness such that they hold the common rod against axial movement in the hollow shaft and stiffen the hollow shaft to change its flexing characteristics.

2. The stabilizer of claim 1 wherein the discs can be adjustably expanded uniformly to increase the stiffness along the cumulative length of all discs.

3. The stabilizer of claim 1 wherein the discs are permanently pre-set to a desired diameter externally of the shaft and forcibly pressed into the shaft and constitute the sole holding force on the shaft against axial movement between the hollow shaft and the common rod.

4. The stabilizer of claim 1 wherein the discs are permanently fixed at one diameter on the rod and are of an external diameter ten to fifteen percent greater than the internal diameter of the shaft and are of a Shore A durometer of 45–60.

5. The stabilizer of claim 4, said rod having rivets with enlarged heads fixed to the rod, said discs being mounted on said rivets in engagement with said heads.

6. The stabilizer of claim 1, wherein there are at least four discs on the rod.

7. The stabilizer of claim 4, wherein the discs are of durometer of 45–50.

8. The method of stiffening a grip end of a hollow golf club shaft having an internal diameter of a predetermined diameter, mounting a plurality of elastomeric discs at spaced locations along a rigid rod, the discs each having a periphery and having a durometer of sufficient stiffness and a diameter greater than said predetermined internal shaft diameter, to provide stiffening of the shaft when forced into tightly compressed condition within the shaft, lubricating the periphery of the discs, and forcibly pressing the rod and discs into the grip end of the shaft.

9. The method of claim 8, wherein the durometer is about 45–60 Shore A durometer.

10. The method of claim 8, wherein the discs' uncompressed diameter is about 10–15 percent greater than said predetermined internal diameter of the shaft.

11. The method of claim 8, including rivets having enlarged heads, including the step of fitting the disc onto the rivets and fixing the rivets to the rod at said spaced locations.

12. The method of claim 11, said discs having a durometer of between 45–60, and being about 10–15 percent larger in uncompressed diameter than the predetermined internal diameter of the shaft.

13. The method of claim 8, the Shore A durometer being greater than 45.

14. A stabilizer for increasing the stiffness of the of a hollow golf club shaft having an internal diameter, comprising, a rigid rod, a plurality of at least two elastomeric discs connected along the rod, the discs each having an external diameter greater than the internal diameter of the hollow shaft and a sufficient durometer so as to be compressed against the internal diameter of the shaft when inserted into the shaft to materially stiffen the shaft against flexing, whereby the rod and discs will stiffen the shaft when inserted in the shaft; the discs hold the common rod against axial movement in the hollow shaft and are of a diameter and hardness to materially stiffen the hollow shaft to change its flexing characteristics.

15. The stabilizer of claim 14, said discs being fixed and not adjustable in said connection to the rod and thereby being compressed by being forcibly inserted into the shaft.

16. The stabilizer of claim 14, said discs being radially adjustably connected to the rod so as to be expanded against the internal diameter of the shaft after being inserted into the shaft.

17. The stabilizer of claim 15, said discs having an uncompressed diameter between 10 and 15 percent larger than the internal diameter of the shaft.

18. The stabilizer of claim 17, said discs being of a Shore A durometer greater than 45.

19. The stabilizer of claim 18, the discs being of a durometer of between 45–60.

* * * * *